US007341458B1

(12) United States Patent
Koh

(10) Patent No.: US 7,341,458 B1
(45) Date of Patent: Mar. 11, 2008

(54) ELECTRICAL SIGNAL TRANSMISSION CONNECTOR ASSEMBLY WITH MAGNETICALLY CONNECTED RECEPTACLE AND PLUG

(76) Inventor: Chao Ming Koh, 4F.-2, No. 82, Dasyue Rd., Hsinchu City 30080 (TW)

( * ) Notice: Subject to any disclaimer, the term of this patent is extended or adjusted under 35 U.S.C. 154(b) by 0 days.

(21) Appl. No.: 11/727,898

(22) Filed: Mar. 28, 2007

(51) Int. Cl.
*H01R 13/60* (2006.01)

(52) U.S. Cl. ..... 439/39; 439/540.1; 439/923

(58) Field of Classification Search ..... 439/21, 439/22, 38–40, 152, 180, 374, 540.1, 541.5, 439/923
See application file for complete search history.

(56) References Cited

U.S. PATENT DOCUMENTS 4,112,941 A * 9/1978 Larimore ..... 600/394
4,874,316 A * 10/1989 Kamon et al. ..... 439/39
5,229,703 A * 7/1993 Harris ..... 320/107
7,056,127 B2 * 6/2006 Suzuki et al. ..... 439/39

* cited by examiner

*Primary Examiner*—James Harvey
(74) *Attorney, Agent, or Firm*—Rabin & Berdo, P.C.

(57) ABSTRACT

An electric signal transmission connector assembly includes at least one plug and a receptacle mounted to an electronic apparatus. The plug and the receptacle are internally provided at two opposite positions with a permanent magnet each, so that the plug may be easily connected to the receptacle through magnetic attraction between the two magnets. The plug and the receptacle also include a plurality of terminals each. When the plug and the receptacle are magnetically connected to each other, the terminals thereof are contacted with one another to enable transmission of electric signals or supply of power via the plug and the receptacle. Two or more plugs may be stacked up to magnetically connect to the same one receptacle to save a lot of space by magnetically connecting a lower connecting section of an upper plug to an upper receiving section of a lower plug.

8 Claims, 7 Drawing Sheets

ELECTRICAL SIGNAL TRANSMISSION CONNECTOR ASSEMBLY WITH MAGNETICALLY CONNECTED RECEPTACLE AND PLUG

FIELD OF THE INVENTION

The present invention relates to an electric signal transmission connector assembly, and more particularly to a connector assembly including a receptacle and at least one stackable plug, which are internally provided with a magnet each, so as to magnetically connect to one another.

BACKGROUND OF THE INVENTION

With the advanced technologies, there are developed more and more types of electronic products, which are able to integrate multiple different functions. For this purpose, there are multiple electric connector assemblies provided on the modern electronic products for connecting to other electronic product for transferring data between them.

A connector assembly on general electronic products, such as earphones, USB devices, power supply, etc., usually includes a male connector or plug that has a projected blade as long as 1 cm to 2 cm for plugging in a female connector or receptacle. The projected blade is held to the receptacle by frictional contact or mortise joint. With these conventional mechanical connecting structures, the plug and the receptacle tend to become damaged and the blade on the plug tends to break when the plug has been plugged or unplugged for many times or at incorrect angular position, or been unintentionally pulled.

To overcome the above problems, connector manufacturers would usually increase the thickness of cables connected to the connectors and enhance the structural strength of the connectors, so that the cables and the connectors may bear large pressure applied to the receptacles by users. However, this way will inevitably increase the weight of cable and form waste of material.

U.S. Pat. No. 4,112,941 published on Sep. 12, 1978 discloses an electrode and magnetic connector assembly. In the assembly, the connector contains a magnet to facilitate mating with an elongated upstanding contact member of the electrode. However, only one single magnet-containing connector can be mated with one contact of the electrode. There is not structure allowing multiple pieces of the magnet-containing connectors to be stacked up and connected to one contact member at the same time.

U.S. Pat. No. 4,874,316 published on Oct. 17, 1989 discloses a connector apparatus; and U.S. Pat. No. 7,056,127 published on Jun. 6, 2006 discloses an audio plug. The connector apparatus of U.S. Pat. No. 4,874,316 and the audio plug of U.S. Pat. No. 7,056,127 are used with a headset and configured for magnetic connection of three contact points to one another. However, these prior do not take electromagnetic shielding of high-frequency signal into consideration, and the plugs thereof could not be stacked up for connecting to the same one receptacle.

SUMMARY OF THE INVENTION

A primary object of the present invention is to provide an electric signal transmission connector assembly that includes a receptacle and at least one plug, which are internally provided with a permanent magnet each, so as to connect to one another through magnetic attraction without the problems of damaged plug or receptacle connected via mechanical structures.

Another object of the present invention is to provide an electric signal transmission connector assembly that includes a receptacle and at least one plug magnetically connected to one another. The plug is so designed that it has an upper side formed into a receiving section and a lower side formed into a connecting section, such that multiple plugs may be stacked up to connect to the same receptacle for transmitting multiple electric signals at the same time.

A further object of the present invention is to provide an electric signal transmission connector assembly that includes a receptacle and at least one plug, which are magnetically connected to one another and include a metal cover each to protect internal magnets against collision and reduce internal and external electromagnetic interference, so as to prevent high-frequency signals from overflowing or leaking.

To achieve the above and other objects, the electric signal transmission connector assembly with magnetically connected receptacle and plug according to the present invention mainly includes a plug and a receptacle mounted on a circuit board in an electronic apparatus.

The plug includes an upper and a lower case that together define an internal space between them to enclose a first magnet, a first transmission assembly, and other metal parts therein.

The first transmission assembly includes a first circuit board, which is connected to a cable and provided with a plurality of holes; a plurality of first terminals mounted to the holes on the first circuit board; and a first insulating member put around the first terminals to hold the first terminals in place while isolate them from one another; and the first insulating member having a slightly outward protruded top. The first magnet is located around the first insulating member. The metal parts include a first metal cover and a metal face plate having a predetermined thickness. The first metal cover is downward covered on and around the first magnet, and then welded to an upper side of the first circuit board, and the metal face plate is welded to a lower side of the first circuit board. With these arrangements, the plug has an upper side formed into a first receiving section and a lower side formed into a first connecting section.

The receptacle includes a second metal cover, a second magnet, and a second transmission assembly.

The second transmission assembly includes a second circuit board having a plurality of holes formed thereon; a plurality of second terminals fitly mounted in the holes on the second circuit board; and a second insulating member put around the second terminals to locate and isolate the second terminals from one another. The second magnet is located around the second insulating member. The second metal cover is connected to the second transmission assembly. With the above arrangements, the receptacle has an upper side formed into a second receiving section for the first connecting section on the plug to connect thereto, and a lower side connected to the circuit board in the electronic apparatus.

In a preferred embodiment of the present invention, each of the first terminals in the plug is mounted in the first insulating member with an upper end located lower than the protruded top of the first insulating member. The first terminal also has a lower end formed into a specially shaped contact end, and an expanded middle section abutted on a top of the first circuit board around the hole thereof. And, the first terminals have sidewalls electrically connected to inner walls of the holes on the first circuit board.

In a preferred embodiment of the present invention, each of the second terminals in the receptacle is mounted in the second insulating member with an upper end located lower than a top of the second insulating member, and has an expanded middle section abutted on a top of the second circuit board around the hole thereof. And, the second terminals have sidewalls electrically connected to inner walls of the holes on the second circuit board.

Wherein, the first and the second metal terminals may be of a solid structure or a tubular structure internally provided with a spring, and are made of an electrically conductive material, such as iron, aluminum, nickel, or copper, and plated with a layer of electrically conductive and anti-oxidative material, such as tin, zinc, nickel, copper, silver, gold, or a composite coating.

In a preferred embodiment of the present invention, the receptacle is mounted on the circuit board in an electronic apparatus, such as a mobile phone, a camera, or a computer, so as to integrate the signal transmission function. When the plug is magnetically connected to the receptacle, digital or analog electric signals may be output to or input from an external electronic apparatus via the connector assembly, and power may be supplied to the electronic apparatus from a power source via the connector assembly.

In a preferred embodiment of the present invention, the metal parts of the plug include a first metal cover and a metal face plate, which are welded to upper and lower sides of the first circuit board, respectively, so as to enclose the first terminals, the first insulating member, and the first permanent magnet between them, and form a metal shield.

In an ideal embodiment of the present invention, the receptacle includes a second metal cover to enclose the second terminals, the second insulating member, and the second magnet therein. The second metal cover is welded at a lower periphery to the second circuit board to form a ground of the metal shield. The second terminals and the ground are led out from the second circuit board to electrically connect to corresponding electrodes on the circuit board of the electronic apparatus.

In a preferred embodiment of the present invention, the first and the second magnet may be of one-piece annular magnets or assembled from multiple units each; and are of Nd—Fe—B magnet or Sm—Co magnet, and plated with a layer of electrically conductive and anti-oxidative material, such as tin, zinc, nickel, copper, silver, gold, or a composite coating.

In a preferred embodiment of the present invention, the metal covers and the metal face plate are made of a ferromagnetic material, such as copper alloys, pure iron, low-carbon steel, or silicon steel, and plated with a layer of electrically conductive and anti-oxidative material, such as tin, zinc, nickel, copper, silver, gold, or a composite coating.

In a preferred embodiment of the present invention, the first and the second insulating member have a non-axisymmetrical outer periphery, and are made of a plastic material.

In a preferred embodiment of the present invention, the first and the second metal covers are further provided with a through opening each.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
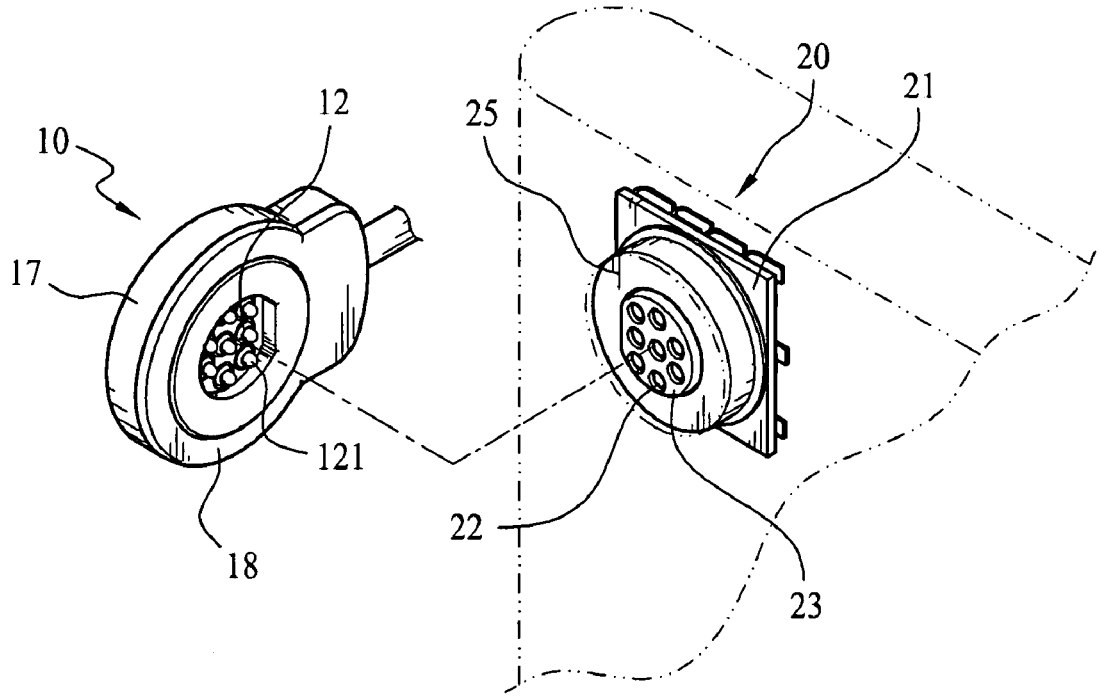
FIG. 1 is a perspective view of an electric signal transmission connector assembly with magnetically connected plug and receptacle according to an embodiment of the present invention.
Figure 2:
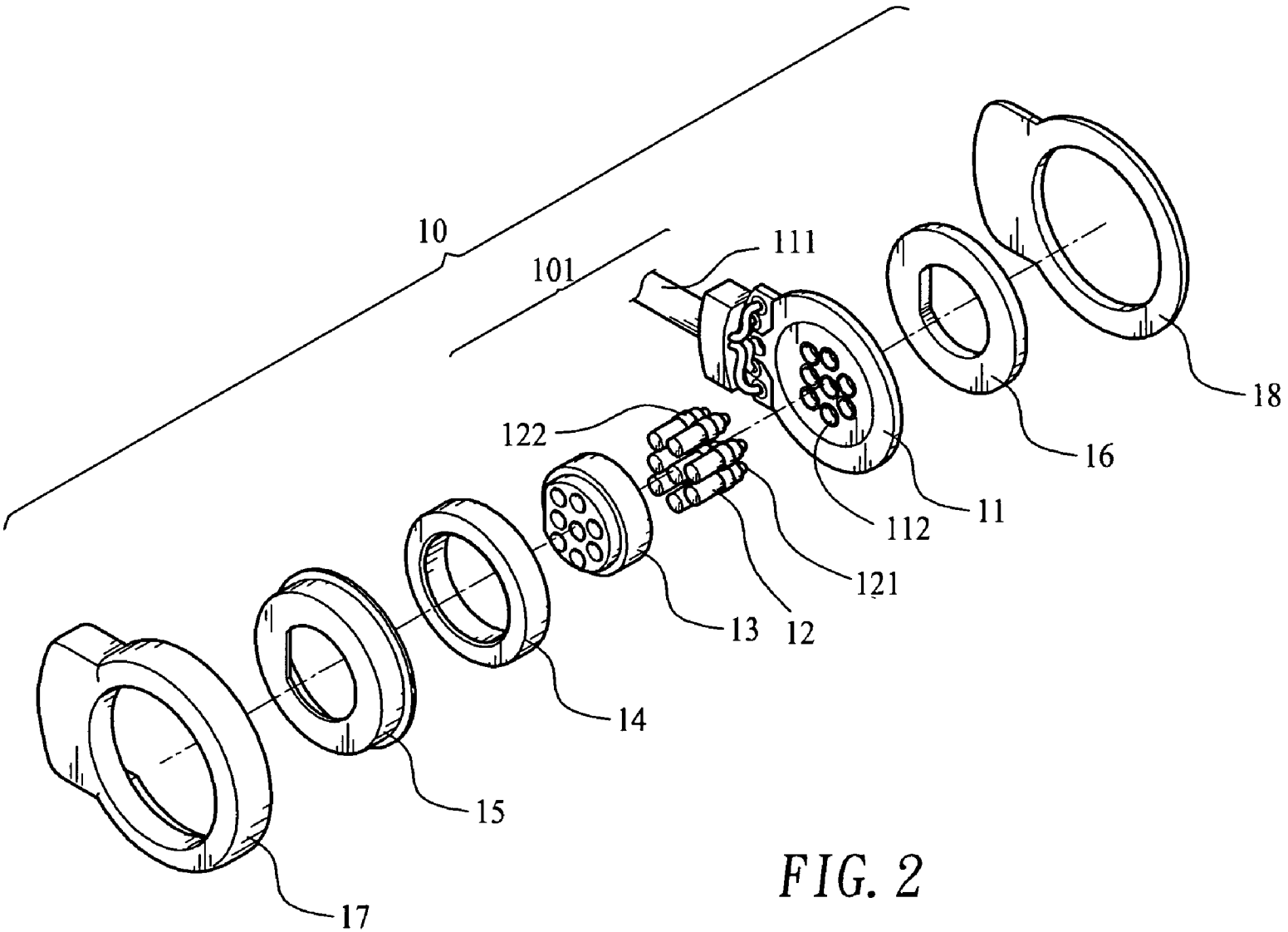
FIG. 2 is an exploded perspective view of the plug of FIG. 1.

Please refer to FIG. 1 that is a perspective view of a connector assembly according to an embodiment of the present invention. As shown, the connector assembly of FIG. 1 includes a plug 10 and a receptacle 20 that are magnetically connected to each other for transmitting electric signals. Please also refer to FIGS. 2 and 3 that are exploded perspective views of the plug 10 and the receptacle 20, respectively. As can be seen from FIGS. 2 and 3, the plug 10 and the receptacle 20 internally include a permanent magnet 14 and 24, respectively, so that the plug 10 can be magnetically connected to the receptacle 20 to enable transmission of electric signals and supply of power via the connector assembly of the present invention.

Figure 4:
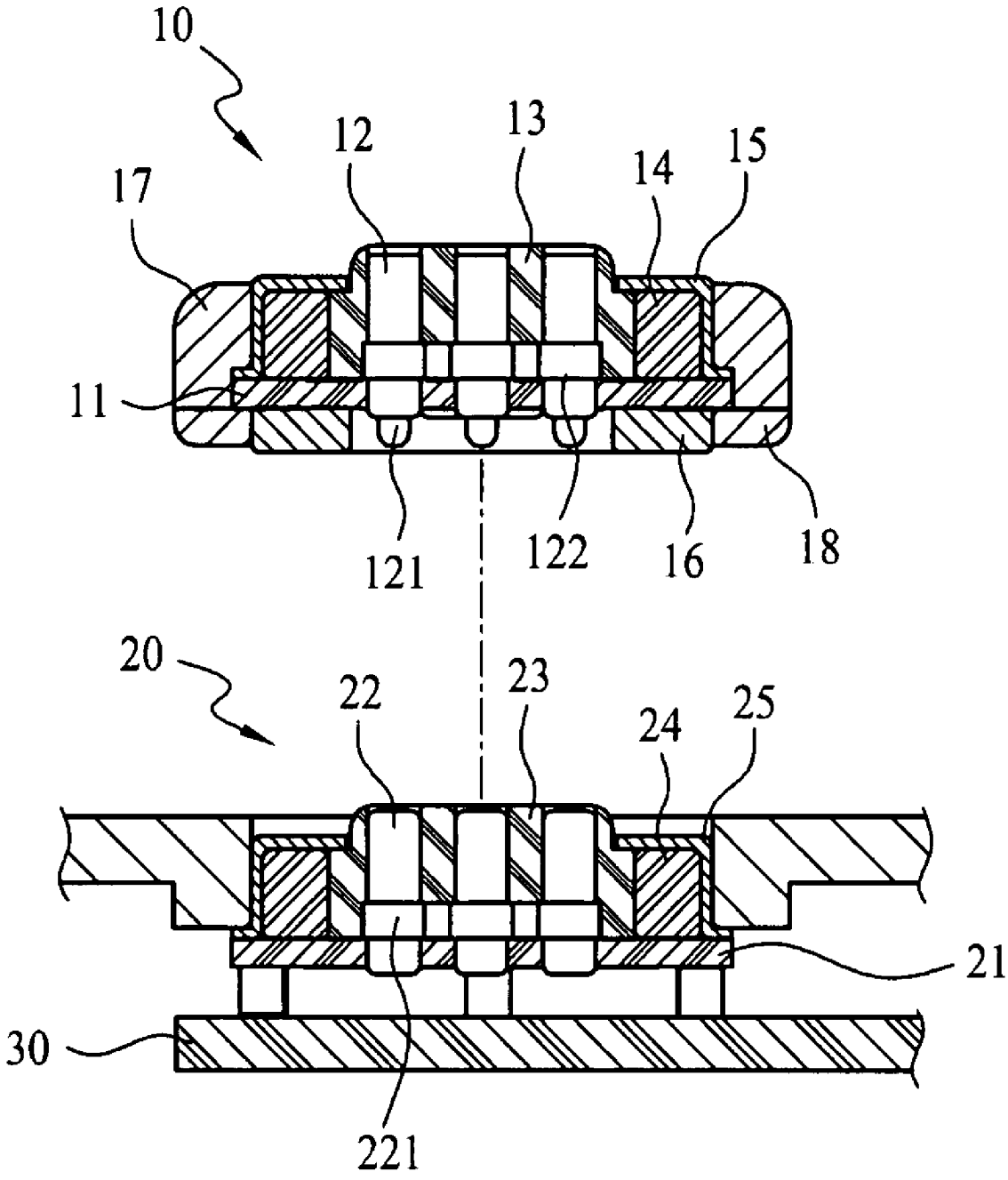
FIG. 4 is a sectioned side view showing the plug and the receptacle of FIG. 1 before being magnetically connected to each other.

FIG. 4 is a sectioned side view showing the plug 10 and the receptacle 20 before being magnetically connected to each other. Please refer to FIGS. 2 and 4 at the same time. The plug 10 includes an upper and a lower case 17, 18 that together define an internal space between them to enclose the magnet 14, a transmission assembly 101, and other metal parts therein. The transmission assembly 101 includes a circuit board 11, which is connected to a cable 111 and provided with a plurality of holes 112; a plurality of terminals 12 mounted to the holes 112; and an insulating member 13 put around the terminals 12 to hold the terminals 12 in place while isolate them from one another. The magnet 14 is located around the insulating member 13. The above-mentioned metal parts include a metal cover 15 having a through opening, and a metal face plate 16 having a predetermined thickness. The metal cover 15 is downward covered on and around the magnet 14, and then welded to an upper side of the circuit board 11; and the metal face plate 16 is welded to a lower side of the circuit board 11.

As can be seen from FIG. 4, the terminals 12 are held in the insulating member 13 with respective upper ends slightly lower than an upward protruded top of the insulating member 13. Each of the terminals 12 has a lower end formed into a specially shaped contact end 121, and an expanded middle section 122. Whereby, when the terminal 12 is downward mounted into the hole 112 on the circuit board 11, the expanded middle section 122 is abutted on the upper side of the circuit board 11 to prevent the terminal 12 from moving downward any further. The terminals 12 are electrically connected at respective side walls to inner walls of the holes 112 on the circuit board 11.

When the metal cover 15 is mounted on and around the magnet 14, the upward protruded top of the insulating member 13 is projected from the through opening of the metal cover 15 by a predetermined distance. The protruded top of the insulating member 13 and the isolated terminals 12 in the insulating member 13 together form an outward projected receiving section. The face plate 16 with a predetermined thickness also has a central opening, which defines a recess when the face plate 16 is welded to the lower side of the circuit board 11. The terminals 12 are mounted in the holes 112 of the circuit board 11 with the contact ends 121 downward protruded into the recess formed between the circuit board 11 and the face plate 16, so that an inward depressed plugging section is formed.

Figure 3:
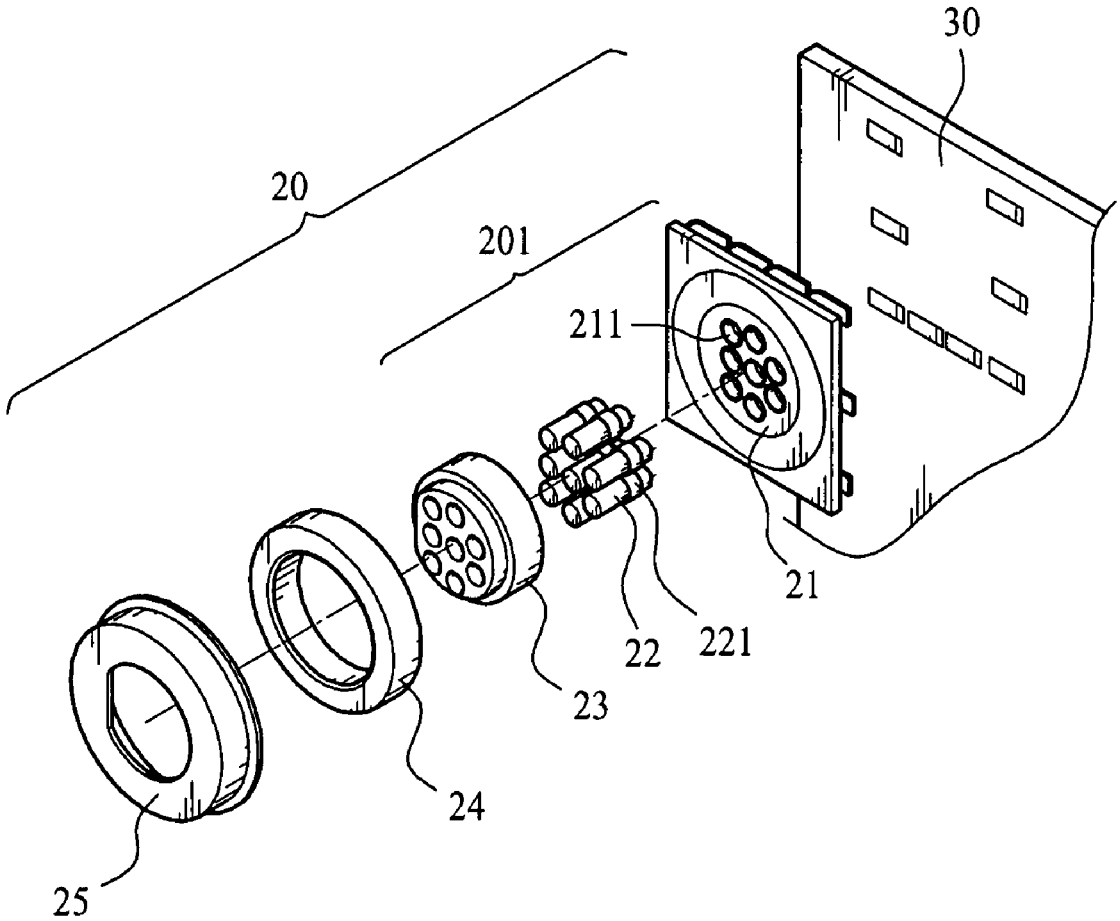
FIG. 3 is an exploded perspective view of the receptacle of FIG. 1.

Please refer to FIGS. 3 and 4 at the same time. The receptacle 20 is mounted to a circuit board 30 provided in an electronic apparatus of any type, so that another electronic device may be connected to that electronic apparatus via the receptacle 20 to input or output digital or analog signals, or to supply power required by that electronic apparatus. As shown, the receptacle 20 includes a transmission assembly 201, the magnet 24, and a metal cover 25 having a through opening. The metal cover 25 covers the magnet 24 and the transmission assembly 201. The transmission assembly 201 includes a circuit board 21 having a plurality of holes 211 formed thereon; a plurality of terminals 22 fitly mounted in the holes 211; and an insulating member 23 put around the terminals 22 to isolate the terminals 22 from one another. The magnet 24 is located around the insulating member 23.

As can be seen from FIG. 4, the terminals 22 are held in the insulating member 23 with respective upper ends slightly lower than an upward protruded top of the insulating member 23. Each of the terminals 22 has an expanded middle section 221. Whereby, when the terminal 22 is downward mounted into the hole 211 on the circuit board 21, the expanded middle section 221 is abutted on an upper side of the circuit board 21 to prevent the terminal 22 from moving downward any further. The terminals 22 are electrically connected at respective side walls to inner walls of the holes 211 on the circuit board 21.

When the metal cover 25 is mounted on and around the magnet 24, the upward protruded top of the insulating member 23 is projected from the through opening of the metal cover 25 by a predetermined distance. The protruded top of the insulating member 23 and the isolated terminals 22 in the insulating member 23 together form an outward projected receiving section.

In a preferred embodiment of the present invention, the metal terminals 12, 22 are made of an electrically conductive material, such as iron, aluminum, nickel, or copper, and are plated with a layer of electrically conductive and anti-oxidative material, such as tin, zinc, nickel, copper, silver, gold, or a composite coating.

The metal terminals 12, 22 may be of a solid structure or a tubular structure internally provided with a spring.

In a preferred embodiment of the present invention, the insulating member 13, 23 have a non-axisymmetrical outer periphery, and are made of a plastic material.

The permanent magnets 14, 24 are of a ferromagnetic material, such as Nd—Fe—B magnet and Sm—Co magnet, and are plated with a layer of electrically conductive and anti-oxidative material, such as tin, zinc, nickel, copper, silver, gold, or a composite coating.

The magnets 14, 24 may be of one-piece annular magnets, or assembled from multiple units each. The magnets 14, 24 respectively have two pole faces separately located at upper and lower sides thereof, so that the plug 10 and the receptacle 20 are connected through magnetic attraction between two different poles.

In a preferred embodiment of the present invention, the metal covers 15, 25, and the metal face plate 16 are made of a ferromagnetic material, such as copper alloys, pure iron, low-carbon steel, silicon steel, etc., and plated with a layer of electrically conductive and anti-oxidative material, such as tin, zinc, nickel, copper, silver, gold, or a composite coating.

The circuit boards 11, 21 of the plug 10 and the receptacle 20, respectively, are made of an insulating material, on which metal wires are fixed at desired positions according to predetermined circuit design. The circuit boards 11, 21 may be conventional printed circuit boards or manufactured by the newly developed metal insertion plastic molding.

Figure 5:
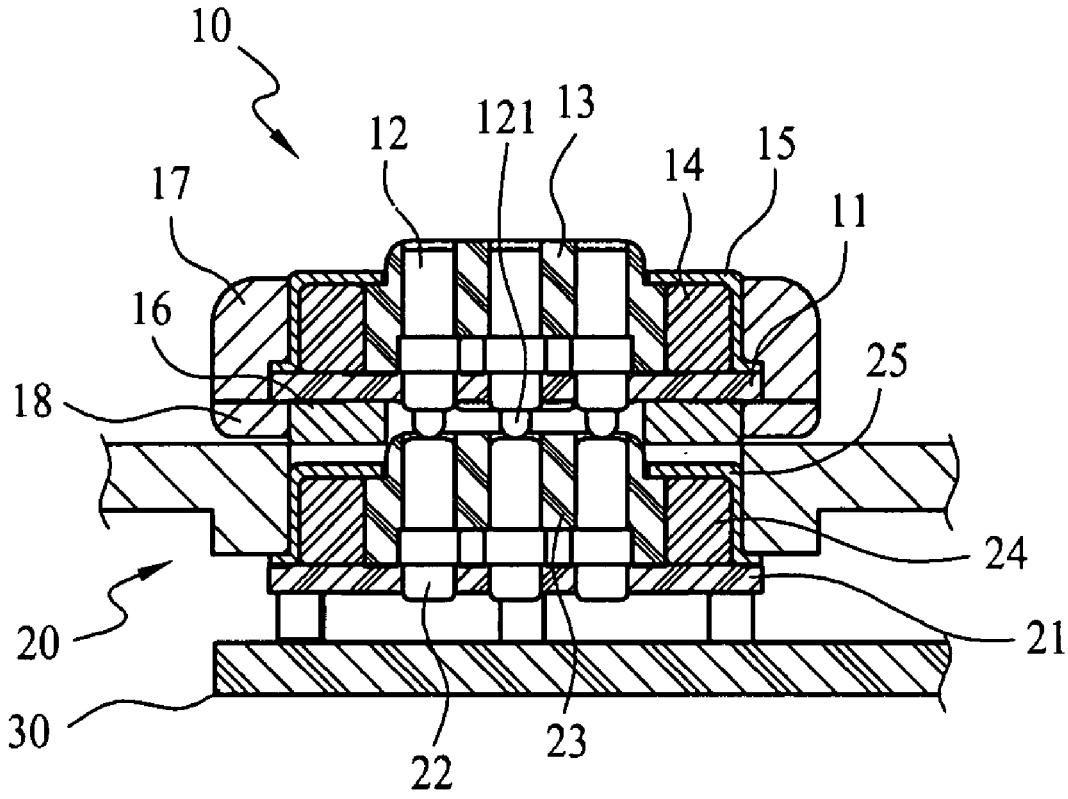
FIG. 5 is a sectioned side view showing the plug and the receptacle of FIG. 4 having been magnetically connected to each other.

FIG. 5 is a sectioned side view showing the plug 10 and the receptacle 20 have been magnetically connected to each other. Please refer to FIG. 5 along with FIGS. 1 to 4. The permanent magnets 14, 24 are located in the plug 10 and the receptacle 20 at two opposite sides, so that the plug 10 and the receptacle 20 are directly aligned with and connected to each other via magnetic attraction without the need of any other external force, bringing the terminals 12, 22 to contact with one another to thereby enable transmission of electric signals and power supply via the connected plug 10 and receptacle 20 of the connector assembly of the present invention.

Due to the magnetic traction, the plug 10 approached to the receptacle 20 is automatically connected to the receptacle 20, allowing transmission of digital or analog electric signals between two electronic apparatuses and/or supply of power from a power source to an electronic apparatus via the connector assembly of the present invention.

The connector assembly of the present invention may be applied to various types of electronic devices, such as MP3 walkman, portable hard disk, digital camera, computer, etc., to serve as a hardware port on a transmission interface.

Please refer to FIGS. 4 and 5 at the same time. The upper case 17 of the plug 10 has an upward extended top formed with a central opening, via which the insulating member 13 is projected from the upper case 17 to form the protruded receiving section. Each of the terminals 12 has a flat upper end surface to serve as a contact surface. The lower case 18 of the plug 10 is mounted around the metal face plate 16, which together with the circuit board 11 define a recess, and the contact ends 121 of the terminals 12 are extended into the recess to form the depressed connecting section.

Figure 6:
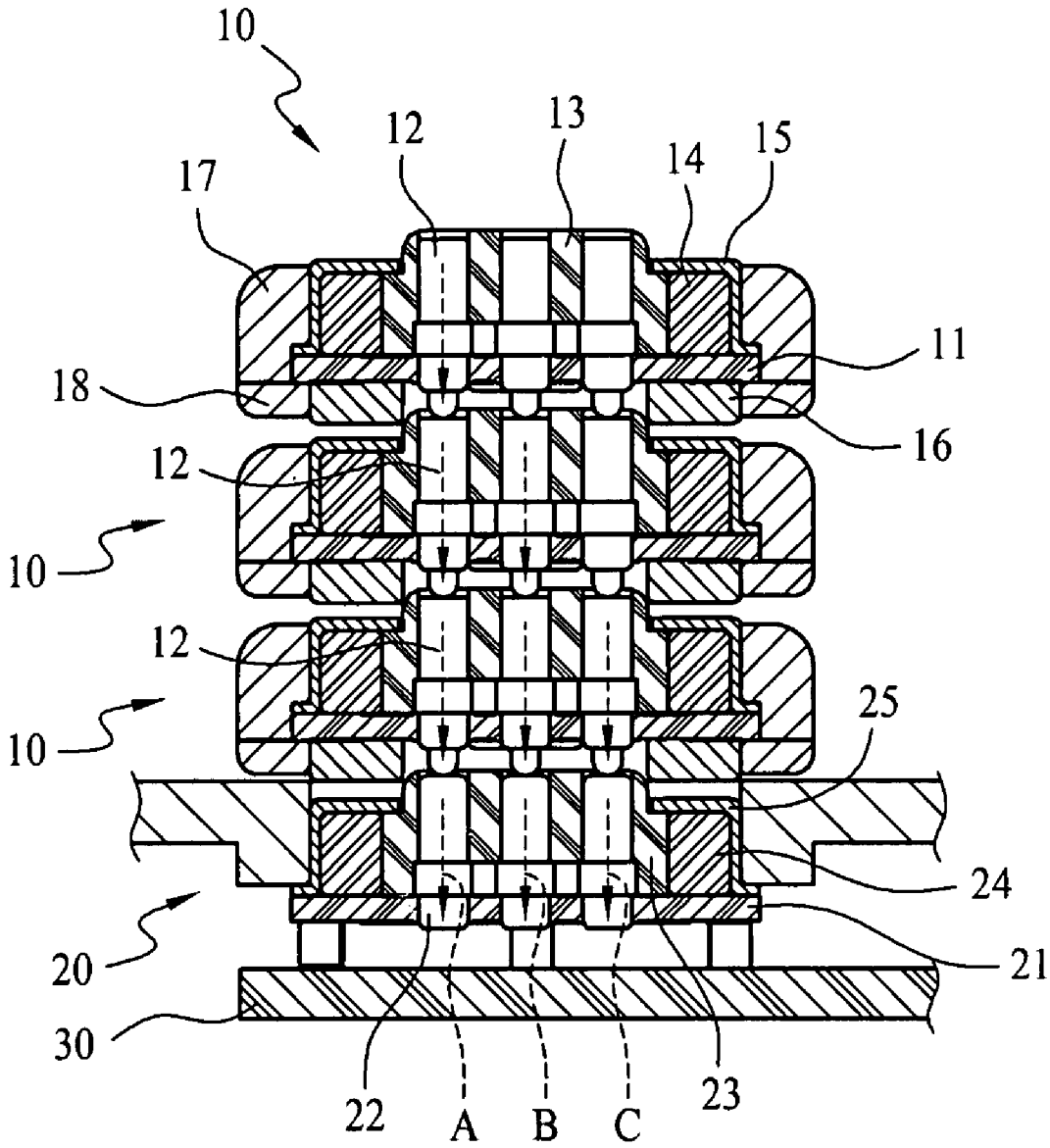
FIG. 6 is a sectioned side view showing another embodiment of the present invention, in which a plurality of continuously stacked plugs are magnetically connected to one receptacle for transmitting multiple electric signals at the same time.

With the above arrangements, each plug 10 has one side formed into the protruded receiving section and another opposite side formed into the depressed connecting section. Therefore, two or more plugs 10 may be stacked up by magnetically connecting the depressed connecting section of an upper plug 10 to the protruded receiving section of a lower plug 10, as shown in FIG. 6. With the specially designed receptacle 20 mounted on the electronic apparatus, electric signals to be transmitted via each one of the stacked plugs 10 may be separately transmitted to the receptacle 20.

As can be seen from the arrows in FIG. 6, different signal sources may be transmitted to the receptacle 20 at the same time. For example, signal A is transmitted via one of the terminals 12 of the topmost plug 10 to the receptacle 20; signal B is transmitted via one of the terminals 12 of a middle plug 10 to the receptacle 20; and signal C is transmitted via one of the terminals 12 of a lowest plug 10 to the receptacle 20. That is, the receptacle 20 may receive different signals at the same time. Therefore, it is not necessary to provide a plurality of receptacles on the electronic apparatus, and the cost for connector assembly can be reduced. Moreover, the spatial arrangement for the connector assembly on the electronic apparatus is simplified to help in the production of even compact and lightweight electronic apparatus.

Figure 7:
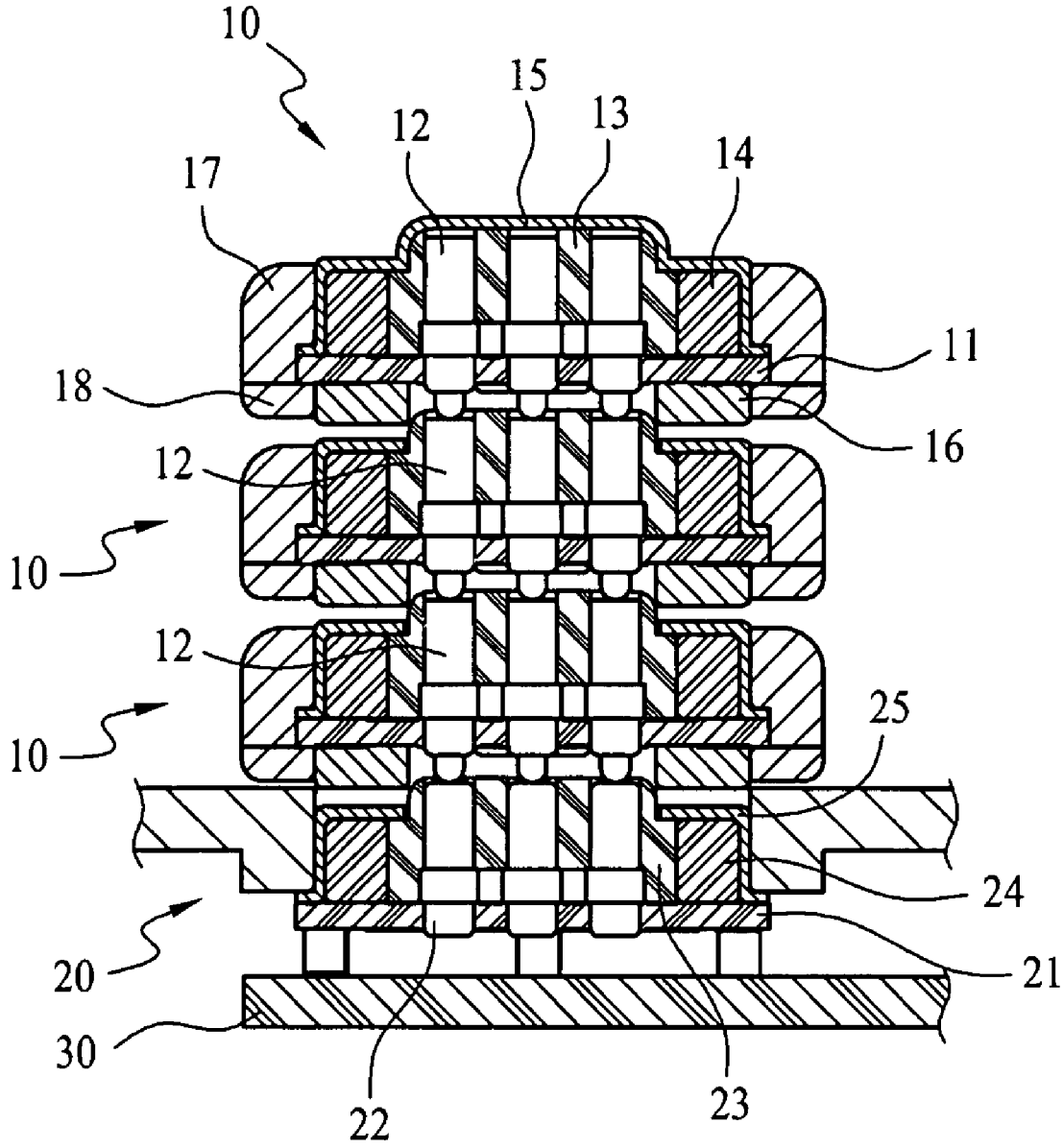
FIG. 7 is a sectioned side view of a preferred embodiment of the present invention.

FIG. 7 shows a preferred embodiment of the present invention that takes the electromagnetic shielding into consideration. For this purpose, the topmost plug 10 has a closed metal cover 15 without the through opening, so as to cover the protruded top of the insulating member 13 and thereby completely shield the insulating member 13 to prevent electromagnetic interference.

In the present invention, the permanent magnets 14, 24 attract each other to easily magnetically connect the plug 10 to the receptacle 20. The problems of damaged plug and receptacle due to incorrect force applying angle or excessive plugging force may therefore be overcome. Moreover, since the connector assembly of the present invention allows multiple plugs 10 to stack up and magnetically connect to the same one receptacle 20, the number of receptacles may be reduced to save a lot of space.

The present invention has been described with some preferred embodiments thereof and it is understood that many changes and modifications in the described embodiments can be carried out without departing from the scope and the spirit of the invention that is intended to be limited only by the appended claims.

What is claimed is:

1. An electric signal transmission connector assembly with magnetically connected receptacle and plug, comprising a plug and a receptacle mounted to a circuit board in an electronic apparatus;

the plug including an upper and a lower case that together define an internal space between them to enclose a first magnet, a first transmission assembly, and other metal parts therein;

the first transmission assembly including a first circuit board, which is connected to a cable and provided with a plurality of holes; a plurality of first terminals mounted to the holes on the first circuit board; and a first insulating member put around the first terminals to hold the first terminals in place while isolate them from one another; and the first insulating member having a slightly outward protruded top;

the first magnet being located around the first insulating member; and the metal parts including a first metal cover and a metal face plate having a predetermined thickness; the first metal cover being downward covered on and around the first magnet, and then welded to an upper side of the first circuit board and the metal face plate being welded to a lower side of the first circuit board;

whereby, with the above arrangements, the plug has an upper side formed into a first receiving section and a lower side formed into a first connecting section; and the receptacle including a second metal cover, a second magnet, and a second transmission assembly;

the second transmission assembly including a second circuit board having a plurality of holes formed thereon; a plurality of second terminals fitly mounted in the holes on the second circuit board; and a second insulating member put around the second terminals to isolate the second terminals from one another;

the second magnet being located around the second insulating member; and the second metal cover being connected to the second transmission assembly;

whereby, with the above arrangements, the receptacle has an upper side formed into a second receiving section for the first connecting section on the plug to connect thereto, and a lower side connected to the circuit board in the electronic apparatus.

2. The electric signal transmission connector assembly with magnetically connected receptacle and plug as claimed in claim 1, wherein the first and the second terminals are of a solid structure.

3. The electric signal transmission connector assembly with magnetically connected receptacle and plug as claimed in claim 1, wherein the first and the second terminals are of a tubular structure internally provided with a spring.

4. The electric signal transmission connector assembly with magnetically connected receptacle and plug as claimed in claim 1, wherein each of the first terminals in the plug is mounted in the first insulating member with an upper end located lower than the protruded top of the first insulating member, and has a lower end formed into a specially shaped contact end, and an expanded middle section; and the first terminals having sidewalls electrically connected to inner walls of the holes on the first circuit board.

5. The electric signal transmission connector assembly with magnetically connected receptacle and plug as claimed in claim 1, wherein each of the second terminals in the receptacle is mounted in the second insulating member with an upper end located lower than a top of the second insulating member, and has an expanded middle section; and the second terminals having sidewalls electrically connected to inner walls of the holes on the second circuit board.

6. The electric signal transmission connector assembly with magnetically connected receptacle and plug as claimed in claim 1, wherein the first and the second magnet are of one-piece annular magnets.

7. The electric signal transmission connector assembly with magnetically connected receptacle and plug as claimed in claim 1, wherein the first and the second magnet are assembled from multiple units each.

8. The electric signal transmission connector assembly with magnetically connected receptacle and plug as claimed in claim 1, wherein the first and the second metal covers are further provided with a through opening each.

* * * * *